US006672930B1

(12) United States Patent
McElhaney

(10) Patent No.: US 6,672,930 B1
(45) Date of Patent: Jan. 6, 2004

(54) PNEUMATIC TOY WITH STACKABLE PLAY PIECES

(75) Inventor: Craig McElhaney, Cumberland, RI (US)

(73) Assignee: Hasbro, Inc., Pawtucket, RI (US)

( * ) Notice: Subject to any disclaimer, the term of this patent is extended or adjusted under 35 U.S.C. 154(b) by 126 days.

(21) Appl. No.: 10/131,695

(22) Filed: Apr. 24, 2002

(51) Int. Cl.[7] ..... A63H 33/40; A63H 29/16

(52) U.S. Cl. ..... 446/89; 446/178

(58) Field of Search ..... 446/178, 179, 446/217, 218, 176, 89, 90; 273/129 AP

(56) References Cited

U.S. PATENT DOCUMENTS

| | | | | |
|---|---|---|---|---|
| 2,985,058 A | | 5/1961 | Morgan | |
| 3,083,497 A | | 4/1963 | Novak et al. | |
| 3,846,933 A | * | 11/1974 | Hill et al. | 446/178 |
| 4,223,471 A | | 9/1980 | Greenberg | |
| 4,250,657 A | | 2/1981 | Barlow et al. | |
| 4,252,273 A | | 2/1981 | Karterman | |
| 4,283,053 A | | 8/1981 | Parker et al. | |
| 4,468,029 A | | 8/1984 | Kulesza et al. | |
| 4,508,346 A | | 4/1985 | Salvucci | |
| 4,579,281 A | | 4/1986 | Karterman | |
| 4,725,256 A | | 2/1988 | Sassak | |
| 4,830,374 A | * | 5/1989 | Follo | 273/317.7 |
| 4,838,550 A | | 6/1989 | Walker et al. | |
| 4,892,310 A | | 1/1990 | Patterson | |
| 5,041,045 A | | 8/1991 | Ohashi | |
| 5,092,808 A | * | 3/1992 | Takasaka et al. | 446/178 |
| 5,314,368 A | | 5/1994 | Cheng | |
| 5,332,364 A | | 7/1994 | Rodarmer | |
| 5,381,719 A | | 1/1995 | Otsuka | |
| 5,522,756 A | | 6/1996 | Barthold | |
| 5,545,071 A | | 8/1996 | Shiraishi | |

* cited by examiner

*Primary Examiner*—Jacob K. Ackun
(74) *Attorney, Agent, or Firm*—Marshall, Gerstein & Borun LLP

(57) ABSTRACT

A toy having movable elements actuated upon introduction of compressed air is disclosed. The toy may include a source of compressed air which is adapted to direct air through a valved port for communication to individual and removable play pieces. Each of the play pieces may include movable elements which are caused to move upon contact with the compressed air. Each of the play pieces may be stackable to allow for simultaneous actuation of multiple play pieces through a single valve.

22 Claims, 6 Drawing Sheets

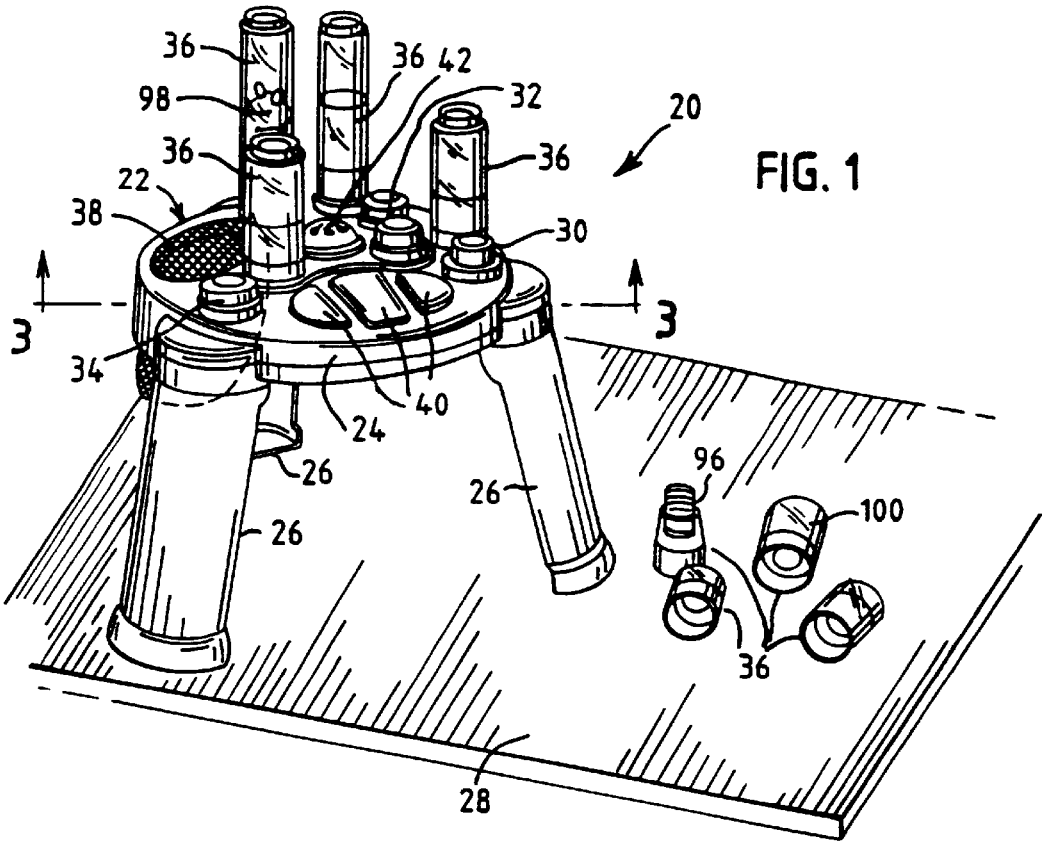
FIG. 1
FIG. 2
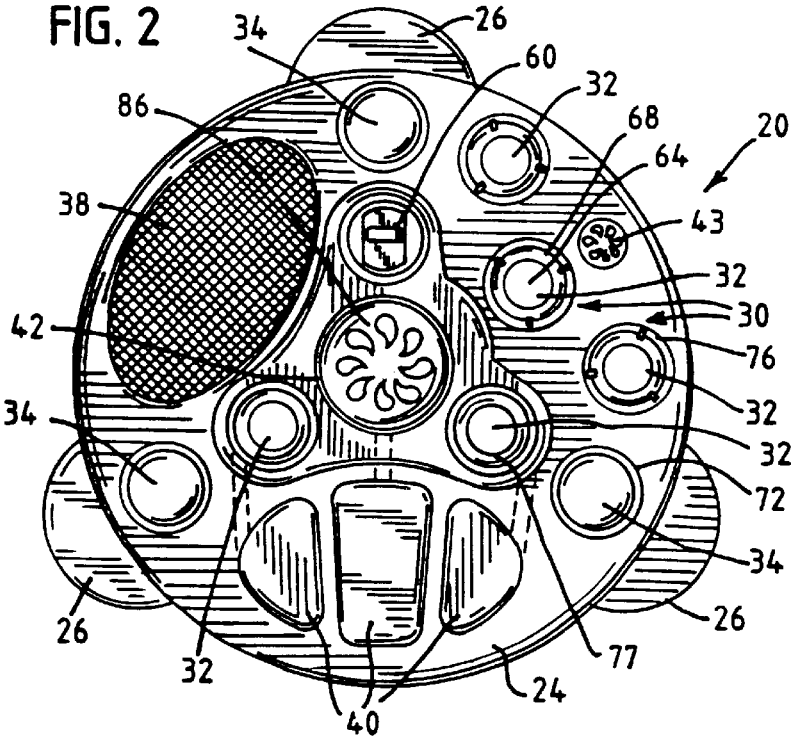

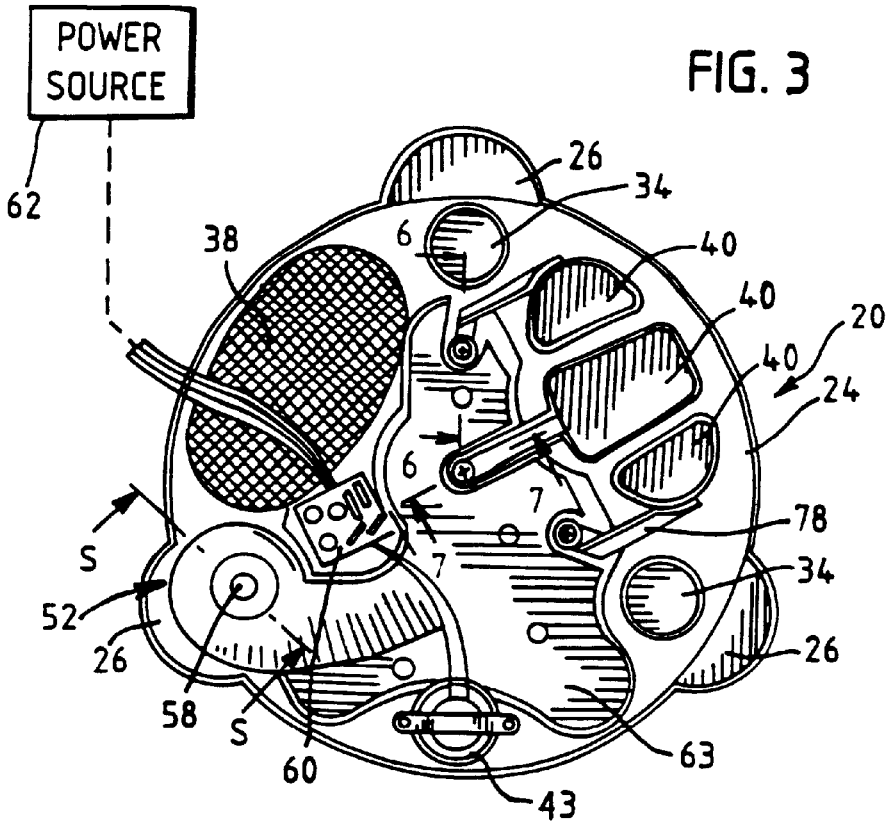
FIG. 3
FIG. 4
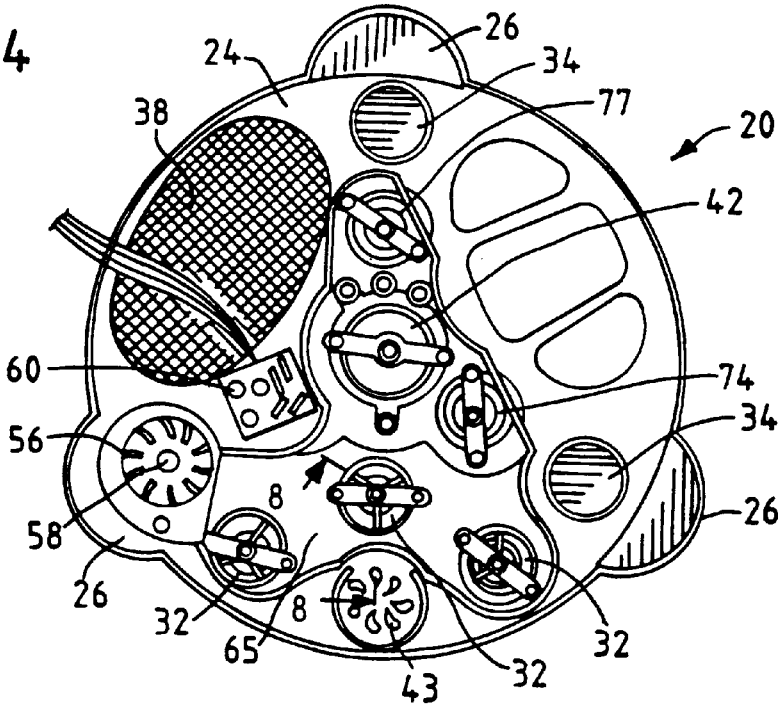

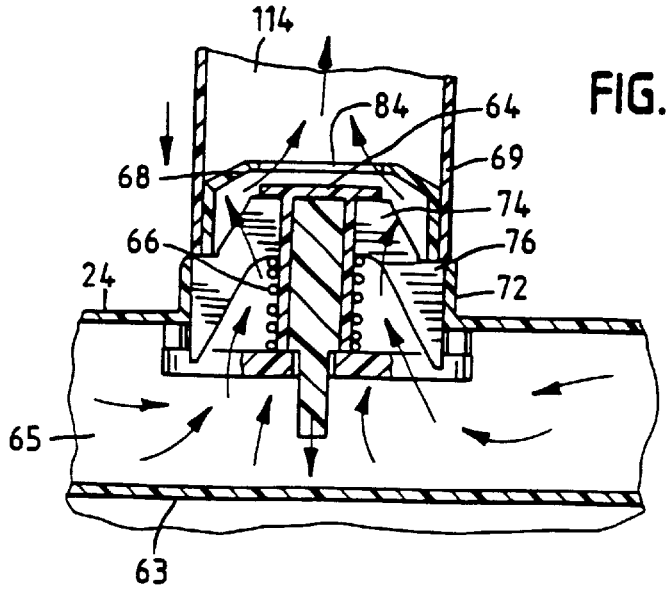
FIG. 8A
FIG. 9
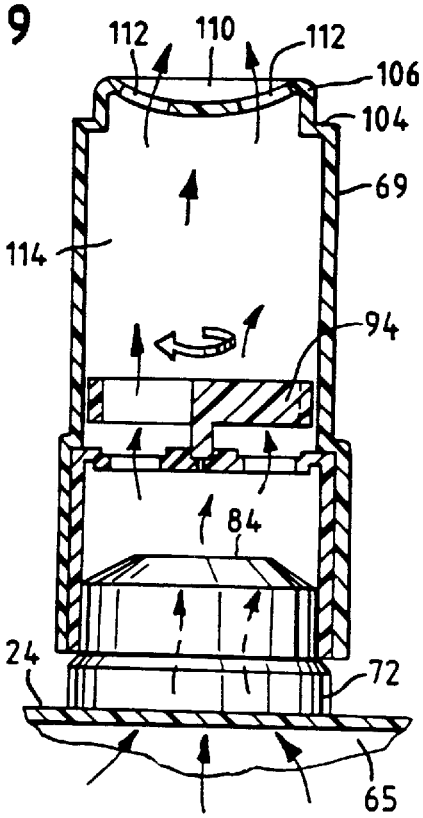
FIG. 10
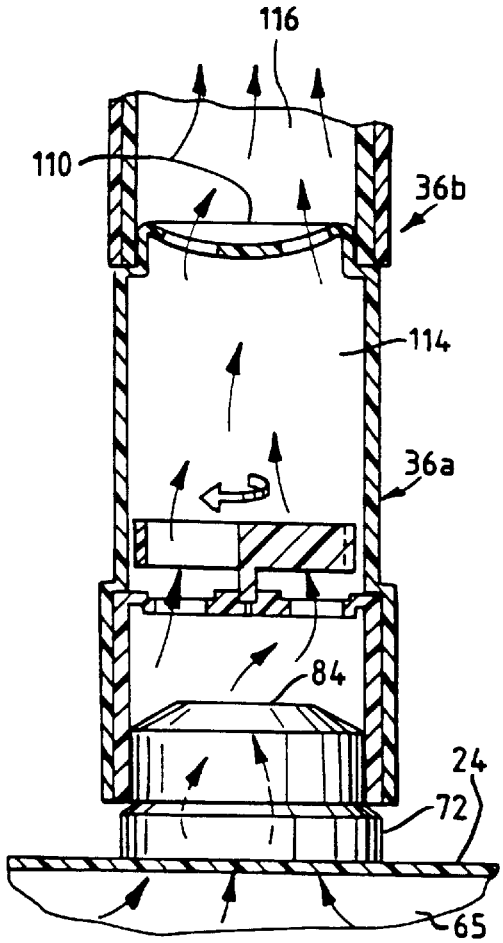

PNEUMATIC TOY WITH STACKABLE PLAY PIECES

FIELD OF THE DISCLOSURE

The disclosure generally relates to toys and, more particularly, relates to toys using compressed air or fluid for actuation of play pieces.

BACKGROUND OF THE DISCLOSURE

Toys using compressed air or other gases, i. e., pneumatic toys, are well known and well received. Such toys can be as straightforward as whistles or plastic pipes which direct a stream of compressed air from a user to an outlet. The compressed air can generate an audible output as with a whistle, or can be used to support a lightweight sphere or other element, in a hovering-type capacity.

In still further embodiments, it is known to generate the compressed air from a motor or fan using electric power. The compressed air can be directed through one or more conduits for moving elements provided therein. For example, Barlow, et al., U.S. Pat. No. 4,250,657, uses the compressed air to move simulated rockets or humanoids from location to location through a tube. Similarly, Shiraishi, U.S. Pat. No. 5,545,071, uses a stream of compressed air to float a figurine within tubes of differing height corresponding to the musical notes of an octave. Depression of a musical keyboard for a given note, not only causes the musical note to be generated, but also causes the corresponding figurine to hover at a predetermined height.

Although such toys are effective and enjoyed, it would be advantageous to provide a toy utilizing compressed air for movement of elements provided within play pieces thereof, while at the same time enabling the individual play pieces of the toy to be removed and individually actuated by the user. It would be still further advantageous to provide such a toy wherein multiple play pieces could be combined and simultaneously actuated.

SUMMARY OF THE DISCLOSURE

In accordance with one aspect of the disclosure, a toy is provided which may comprise a housing, a source of compressed air, a valve, and a play piece. The housing may have at least one port. The source of compressed air may be mounted within the housing and be adapted to direct an air stream toward the port. The valve may be mounted in the housing and bias the port into a closed position. The play piece may be adapted to be mounted to the port and have an actuator adapted to open the valve upon mounting to the port.

In accordance with another aspect of the disclosure, a toy is provided which may comprise a first play piece and a second play piece. The first play piece may include an inlet and an outlet with the inlet being adapted to receive compressed air and the outlet being adapted to expel compressed air. The first play piece may further include at least one element adapted to move upon contact with the compressed air. The second play piece may also include an inlet and an outlet but may further be stackable upon the first play piece outlet. The compressed air expelled from the first play piece outlet may be directed through the second play piece inlet. The second play piece may further include at least one element adapted to move upon contact with compressed air.

In accordance with another aspect of the disclosure, a method of using a toy is disclosed which may comprise the steps of providing a first play piece, stacking a second play piece on the first play piece, and directing compressed air through the first play piece and second play piece. More specifically, the first play piece may include an inlet, an outlet, and at least one element mounted within the play piece and adapted to move upon contact with compressed air. The second play piece may also include an inlet, an outlet, and at least one element mounted within the play piece and adapted to move upon contact with compressed air. The inlet of the second play piece may be in fluid communication with the outlet of the first play piece when stacked. Compressed air is directed through the first play piece inlet, first play piece outlet, second play piece inlet, and second play piece outlet.

These and other aspects and features of the disclosure will become more apparent upon reading the following detailed description when taken in conjunction with the accompanying drawings.

BRIEF DESCRIPTION OF THE DRAWINGS

FIG. 1 is an isometric view of a toy constructed in accordance with teachings of the disclosure;

FIG. 2 is a top view of the toy of FIG. 1 without play pieces mounted thereto;

FIG. 3 is a sectional view of the toy of FIG. 1 taken along line 3—3 of FIG. 1;

FIG. 4 is a sectional view of the toy similar to FIG. 3, but with an internal cover removed;

FIG. 8*a* is a sectional view similar to FIG. 8, but depicting the valve in an open position;

FIG. 9 is a sectional view of an entire play piece mounted to a valve;

FIG. 10 is a sectional view similar to FIG. 9, but depicting a second play piece stacked on top of the first play piece.

Figure 5:
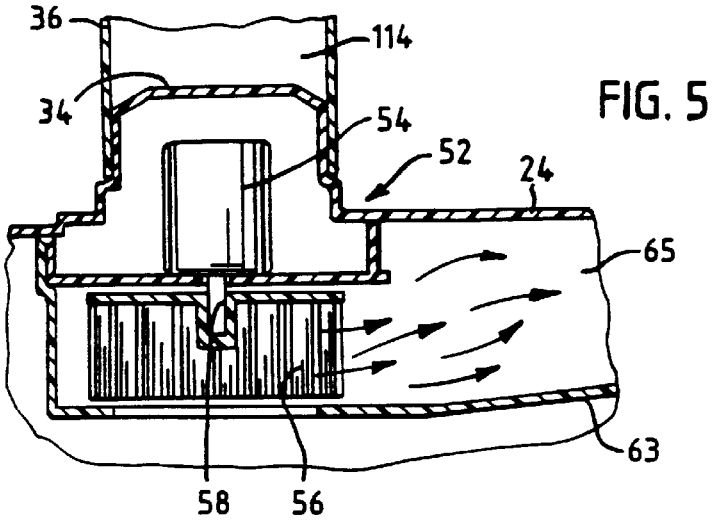
FIG. 5 is a sectional view of the blower motor and wheel of the toy of FIG. 1 taken along line 5—5 of FIG. 3.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the disclosure as defined by the appended claims.

DETAILED DESCRIPTION OF THE DISCLOSURE

Referring now to the drawings, and with specific reference to FIG. 1, a toy constructed in accordance with the teachings of the disclosure is generally referred to by reference numeral 20. While the following description will be provided in conjunction with a play table 22, it is to be understood that the teachings of the disclosure can be effectively employed in a variety of devices wherein a source of compressed air is to be directed through various play pieces for individual or simultaneous actuation of movable elements provided within the play pieces.

With reference now to the specific embodiment of FIGS. 1 and 3, it can be seen that the table 22 includes a base 24 from which a plurality of legs 26 extend for elevating the base 24 from a play surface 28. The base 24 includes a plurality of ports 30. Certain ports 30 are adapted to have airflow therethrough and are referred to as active ports 32, while other ports are not adapted to have airflow therethrough and are referred to as dormant ports 34. Each of the ports 30 is sized to receive a play piece 36 in a removable fashion as will be described in more detail below. Moreover, the base 24 includes a basket or net 38 adapted to store play pieces 36 as well as a plurality of actuation buttons 40, a central pod 42, and a sparkler 43. It will be appreciated that each of the play pieces 36, eight of which are shown in FIG. 1, are adapted to be mounted onto each of the ports 30 for activation of each of the play pieces 36. A different number of ports 30 and play pieces 36, as well as different shapes and layouts are certainly possible and encompassed within the scope of the disclosure.

Depending upon the type of port 30 to which the play piece 36 is mounted, airflow may be communicated automatically thereto, at the user's direction, or not at all. The airflow may be derived from a compressed air source 52 which may be provided in the form of a motor 54 having an impeller 56 attached to a shaft 58 thereof as shown best in FIG. 5. A switch 60 may be provided on the base 24 for actuation or energization of the motor 54 from a battery 62 or alternatively from an AC power source (not shown). A shroud or cover 63 may be provided to define a plenum 65 through which the compressed air is traversed to the ports 30.

Figure 8:
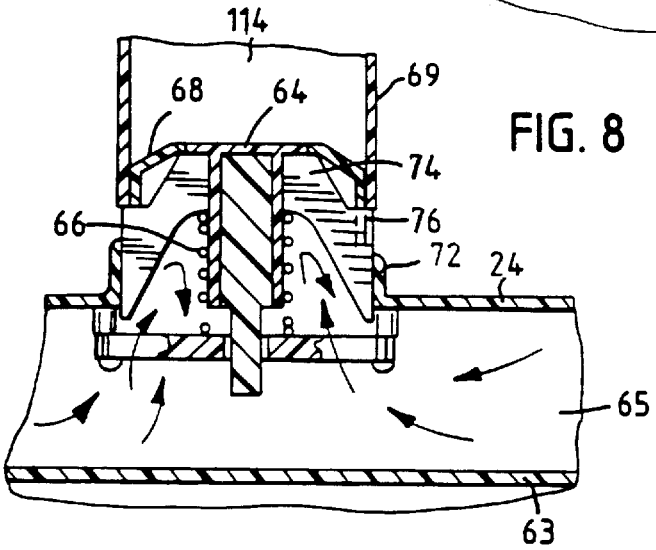
FIG. 8 is a sectional view of a movable play piece actuated valve taken along line 8—8 of FIG. 4, and depicting the valve in a closed position.

With reference to the active port 32 depicted in FIGS. 8 and 8*a*, it is shown to include a valve plate 64 which is biased by a spring 66 into closed, sealed engagement with a rim 68 of the port 32. Accordingly, when no force is provided to overcome that imparted by the spring 66, the valve plate 64 is closed. However, when the play piece 36 is mounted to the port 30, a housing 69 thereof causes the valve plate 64 to depress and thereby open. More specifically, each of the play piece housings 69 include a base 70 which is recessed for mounting onto cylindrical hub 72 of each port 30. Each valve plate 64 is connected to support structure 74 which may include a plurality of actuation prongs 76 extending through the cylindrical hub 72. In the depicted embodiment, three such prongs 76 extend through the hub 72, but it is to be understood that a lesser or greater number are possible. In so doing, it can be seen that depression of the play piece 36 onto the hub 72 causes the base 70 to engage and depress the prongs 76. Depression of the prongs causes the spring 66 to compress and the valve plate 64 to move away from the rim 68 to open the port 32 as shown best in FIG. 8*a*. The play pieces 36 can be sized so as to frictionally interfit with the port 30 and thereby maintain the valve plate 64 in an open position or can be sized so as to require a downwardly depressing force of a user to hold the play piece 36 thereon and thus open the port 32.

Figure 6:
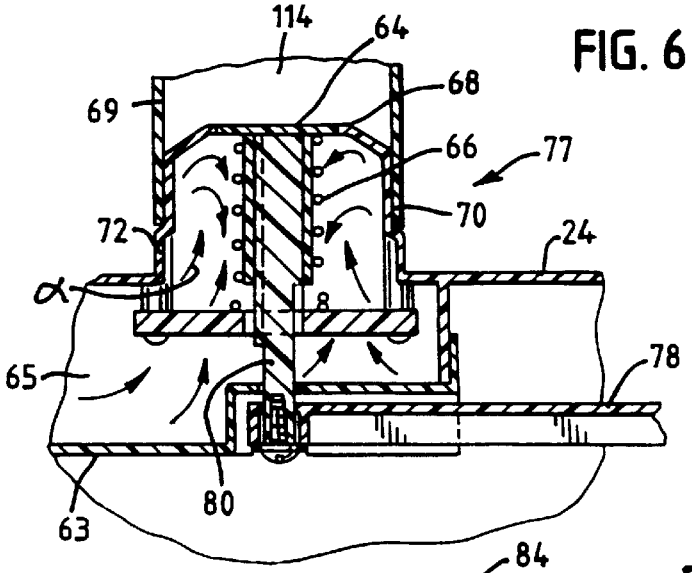
FIG. 6 is a sectional view of the valved port of the toy of FIG. 1 taken along line 6—6 of FIG. 3, with the valve shown in a closed position.
Figure 6A:
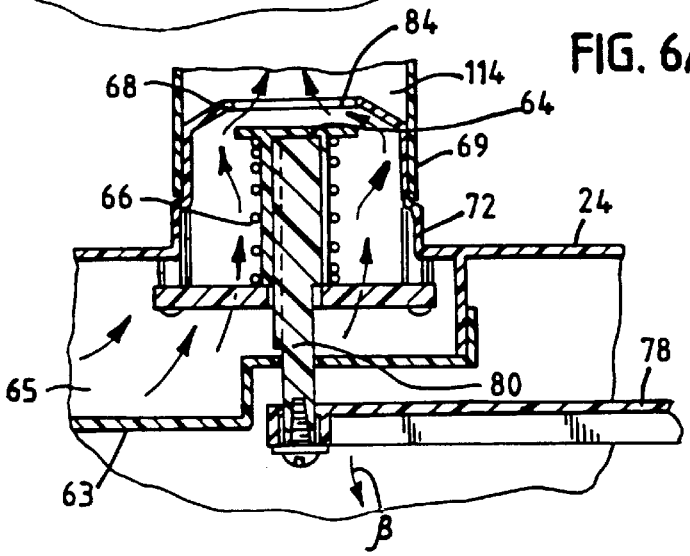
FIG. 6*a* is a sectional view similar to FIG. 6, but with the valve shown in an open position.

With certain other types of ports 30 provided in the toy 20, the valve plate 64 is remotely actuated as shown in FIG. 6 and 6*a*. For example, such a remote-actuated port 77 still includes the valve 64 spring-biased by a spring 66 into a closed position, but further includes an actuation lever 78 directly connected to the valve seat 64 by a connecting pin 80. As shown in FIG. 3, each actuation lever 78 is also connected to one of the actuation buttons 40 extending through the play table 22. In such a port 77, the valve seat 64 is opened upon depression of the actuation button 40 regardless of the position of the play piece 36. Accordingly, the play piece 36 can be mounted on such a port 77 and be actuated or deactuated at the discretion of the user acting upon the actuation button 82.

More specifically, the remotely-actuated port 77 is shown in a closed position in FIG. 6 wherein it can be seen that air directed by the impeller 58 and represented by arrows $\alpha$, can be communicated to the port 77 without exiting the port because the valve plate 64 is normally biased by the spring 66 into engagement with the rim 68. However, as shown in FIG. 6*a*, downward depression of the actuation lever 78, represented by an arrow $\beta$ causes the connecting pin 80 and thus the valve seat 64 to move downwardly relative to the rim 68. In so doing, the air generated by the impeller 58 is able to exit the port 77 through a top opening 84.

Figure 7:
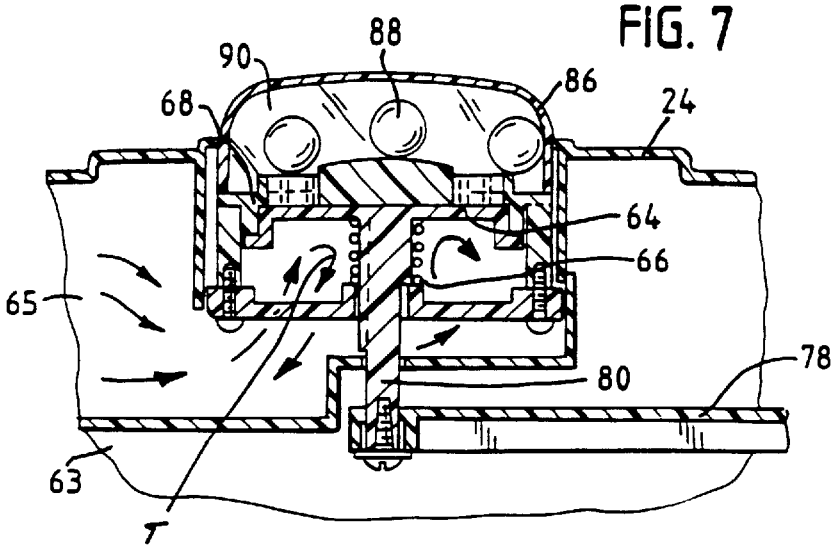
FIG. 7 is a sectional view of the user actuated valve with a fixed play piece, and showing the valve in a closed position.
Figure 7A:
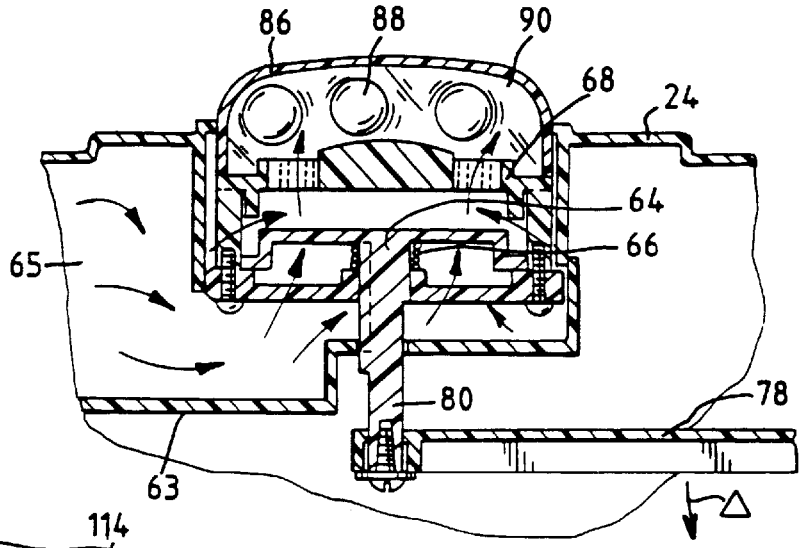
FIG. 7*a* is a sectional view similar to FIG. 7 but depicting the valve in an open position.

Another type of remotely-actuated port 30 is the central pod 42 depicted in FIGS. 7 and 7*a*. While the pod 42 is remotely actuated, it is not adapted to receive an individual play piece 36, but rather includes a fixed window 86 enabling a user to view movable balls 88 provided therein. More specifically, the pod 42 includes a valve plate 64 biased by a spring 66 into engagement with a rim 68. When in such a closed position (FIG. 7) it can be seen that the air generated by the impeller 58 and represented by arrows $\gamma$, is not able to exit into a display chamber 90 and thus the balls 88 are normally dormant. However, downward depression of the actuation lever 78 as indicated by an arrow 6, causes the connecting pin 80, and thus the valve plate 64 to move away from the rim 68 and thereby allow for the compressed air to enter into the display chamber 90 and cause the balls 88 provided therein to move.

Turning to the actual movable elements 92 provided within each play piece 36, the possibilities are myriad. Only eight examples of such pieces are depicted in the figures and will be listed herein, but it needs to be understood that any type of element could be added to one of the play pieces 36 and if sufficiently lightweight, or if mounted for rotation or the like, can be adapted for movement upon contact with the compressed air. By way of example only, the pieces depicted and described include a pinwheel 94, a paddlewheel 96, a telescoping or floating character 98, the plurality of loose spheres 88, and a whistle 100. One of ordinary skill in the art will readily understand that upon injection of compressed air into one of the play pieces 36, the force of the compressed air is sufficient to overcome the weight of the movable elements 92 and thereby cause motion thereof, to the amusement of the user.

Another feature of the toy 20 includes the stackability of each of the play pieces 36. As shown best in FIGS. 9 and 10, each of the housings 69 may include a reduced diameter head 106 and a larger diameter docking shoulder 108 proximate an outlet 110. Each of the outlets 110 may include a plurality of apertures 112 to allow for exhaust of compressed air. The reduced diameter head 106 and the recessed base 70 allow for the stacking of multiple play pieces 36, as shown in FIG. 10, and thus simultaneous actuation of multiple play pieces 36. More specifically, the reduced diameter head 106 of a first play piece 36*a* can be inserted into the recessed base 70 of a second play piece 36*b*. In so doing, an interior 114 of the housing 69 of the first play piece

36*a* is automatically in fluid communication with the interior 116 of the second play piece 36*b* via the outlet 110 of the first play piece 36*a* and the base 70 of the second play piece 36*b*. Accordingly, any compressed air injected into the first play piece 36*a* is automatically traversed through not only the first play piece 36*a*, but the second play piece 36*b* as well, thereby causing the movable elements 92 from the first and second play pieces 36*a* and 36*b* to be simultaneously moved upon opening the port 30. One of ordinary skill in the art will thereby recognize that multiple play pieces 36, in excess of two, can be stacked for simultaneous actuation.

In operation, the toy 20 can be used by mounting one or more play pieces 36 onto one more ports 30 and opening the valve plate 64 associated with the port 30. Therefore, once the motor 54 is energized, by use of the switch 60, compressed air from the impeller 58 is communicated through the port 30 and into the play piece 36. Introduction of compressed air into the housing 69 of the play piece 36 causes the movable element 92 mounted therein to be moved at the force of the compressed air. Moreover, the user is able to readily mix and match the play pieces 36 with each of the ports 30 so that the play pieces can be actuated upon depression of the actuation button 40 and the associated port 30, or simply by mounting one of the play pieces 36 to one of the directly-actuated ports 32. In a still further variation, multiple play pieces 36 can be mounted or stacked one on top of the other to allow for simultaneous actuation of multiple play pieces 36 through a single port 30.

Figure 11:
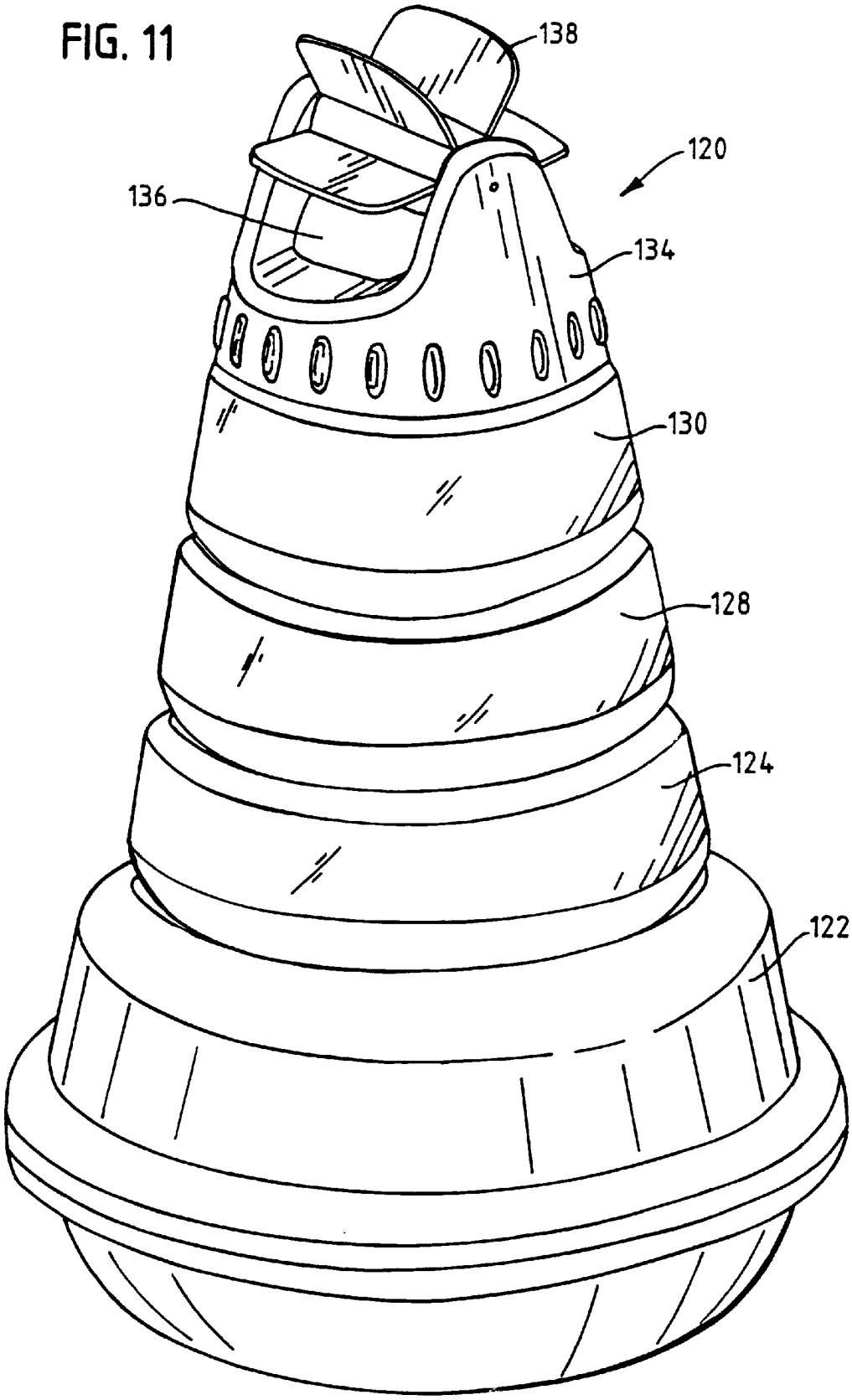
FIG. 11 is an isometric view of an alternative embodiment of a toy constructed in accordance with the teachings of the disclosure.

In an alternative embodiment, such as that depicted in FIG. 11, the stackability feature of the present disclosure can be alternatively attained. More specifically as shown therein, such an alternative toy 120, could include a base 122 containing a motor and impeller (not shown) adapted to generate an air stream in an upward direction. A first play piece 124 of a slightly reduced diameter relative to that of the base 122 could be stacked onto the base 122 with an inlet thereof adapted to be placed in fluid communication with the compressed air being exhausted from an outlet of the base 122. A second play piece 128, could then be stacked on top of the first play piece 124 to allow for compressed air exhausted from the first play piece 124 to be received therein. Additional play pieces 130, 132, and 134 could be stacked in a similar fashion to allow for compressed air generated in the base 122 to be exhausted through each of the play pieces and exhausted through the top outlet 136. It will be noted that each of the play pieces could be provided in a slightly descending diameter to provide the substantially conical shape depicted in the toy 120. Furthermore, each of the play pieces could include different movable elements. For example, as shown in FIG. 11, the top play piece 134 may include a paddle wheel 138 adapted to be rotated upon contact with compressed air, while each of the intermediate play pieces could include a plurality of movable elements such as the lightweight spheres, pinwheels, and characters referenced above which would be cause to move within each play piece upon contact with compressed air. While not depicted, the toy could be used with only a single play piece, with the play pieces in a different order, or with a different number of play pieces altogether.

From the foregoing, it will be readily understood that the present disclosure teaches an apparatus and method for manufacturing and using a pneumatic toy.

What is claimed is:

1. A toy, comprising:

a base having at least one port;

a source of compressed air mounted within the base and adapted to direct an air stream toward the port;

a valve plate mounted in the housing biasing the port into a closed position; and a play piece adapted to be mounted to the port, the play piece having a housing adapted to open the valve upon mounting to the port.

2. The toy of claim 1, wherein the play piece includes at least one movable piece mounted in the play piece and adapted to move as air is directed through the valve port to the movable piece.

3. The toy of claim 1, wherein the port includes a spring biasing the valve plate into a closed position, and wherein the play piece housing is adapted to depress the valve plate when the play piece is mounted to the port.

4. The toy of claim 1, wherein the port further includes a pronged structure connected to the valve plate and adapted to be engaged by the play piece housing.

5. The toy of claim 1, wherein the housing includes a plurality of ports, each port having a valve plate.

6. The toy of claim 1, wherein the source of compressed air includes a motor and impeller.

7. The toy of claim 1, wherein the toy includes a plurality of play pieces.

8. The toy of claim 7, wherein the plurality of play pieces are stackable, air from the source of compressed air adapted to be communicated from the port through multiple, stacked, play pieces.

9. The toy of claim 8, wherein each play piece includes a top aperture and a docking shoulder, the docking shoulder being sized to nest within a base of each play piece.

10. The toy of claim 9, wherein the plurality of play pieces are selected from the group consisting of wind mills, figurines, rotating wheels, floating balls, whistles, and telescoping elements.

11. A toy, comprising:

a first play piece, the play piece having an inlet and an outlet, the inlet being adapted to receive compressed air, the outlet being adapted to expel compressed air, the play piece having at least one element adapted to move upon contact with compressed air; and a second play piece having an inlet and an outlet, the second play piece inlet being stackable upon the first play piece outlet, compressed air expelled from the first play piece outlet being directed through the second play piece inlet, the second play piece including at least one element adapted to move upon contact with compressed air.

12. The toy of claim 11, wherein each play piece includes a reduced diameter head, a larger diameter shoulder proximate the outlet, and a recess proximate the inlet, the head of each play piece being adapted to nest within the recess of the other play piece.

13. The toy of claim 12, wherein the head includes a plurality of apertures therein.

14. The toy of claim 11, further including a base to which each of the play pieces can be mounted, the base including a source of compressed air adapted to direct compressed air through each of the play piece inlets.

15. The toy of claim 14, wherein the base includes a valve adapted to control flow of compressed air from the source of compressed air to the play pieces, the valve being biased into a closed position, mounting of the play pieces to the base causing the valve to open.

16. The toy of claim 14, wherein the base includes a valve adapted to control flow of compressed air from the source of compressed air to the play pieces, the valve being biased into a closed position, the base further including a user engageable actuator adapted to open the valve.

17. A method of using a toy, comprising:

providing a first play piece having an inlet, an outlet, and at least one element mounted within the play piece and adapted to move upon contact with compressed air;

stacking a second play piece onto the first play piece, the second play piece having an inlet, an outlet, and at least one element mounted within the play piece and adapted to move upon contact with compressed air, the inlet of the second play piece being in fluid communication with the outlet of the first play piece when stacked; and directing compressed air through the first play piece inlet, first play piece outlet, second play piece inlet and second play piece outlet.

18. The method of claim 17, further including stacking multiple play pieces together.

19. The method of claim 17, wherein the compressed air is directed through the first play piece by mounting the first play piece to a base having a port therein.

20. The method of claim 19, wherein the base further includes a source of compressed air and a valve mounted in the port.

21. The method of claim 20, wherein the valve is opened by mounting the play piece to the port.

22. The method of claim 20, wherein the valve is opened by depressing an actuator operatively associated with the valve.

* * * * *